US007240590B1

(12) United States Patent
Lin

(10) Patent No.: US 7,240,590 B1
(45) Date of Patent: Jul. 10, 2007

(54) QUICK RELEASE DEVICE FOR RATCHET TOOLS

(76) Inventor: Tsung-Da Lin, 5F-2, No. 181, Sec 2, Mei-Tsun Rd., Taichung City (TW)

( * ) Notice: Subject to any disclaimer, the term of this patent is extended or adjusted under 35 U.S.C. 154(b) by 0 days.

(21) Appl. No.: 11/414,217

(22) Filed: May 1, 2006

(51) Int. Cl.
*B25B 13/46* (2006.01)

(52) U.S. Cl. ..... 81/63; 81/177.85

(58) Field of Classification Search ..... 81/60, 81/61, 62, 63, 63.1, 63.2, 177.85, 58, 58.4, 81/59.1
See application file for complete search history.

(56) References Cited

U.S. PATENT DOCUMENTS 6,901,827 B1 * 6/2005 Yen ..... 81/177.85
7,066,055 B1 * 6/2006 Lee ..... 81/63

* cited by examiner

*Primary Examiner*—Jacob K. Ackun, Jr.

(57) ABSTRACT

A ratchet tool includes a bar movably received in an operation space defined between an inner periphery of a cylindrical space in the head of the ratchet tool and a flat surface defined in an outer periphery of the cylindrical body of the driving mechanism. The bar is pushed toward two wedge-shaped areas in the operation space to control the effective direction of the driving mechanism. The bar is pushed to either one of the two wedge-shaped areas by two positioning units which are movably received in the cylindrical body. The tow positioning units are shifted alternatively by a shifting member mounted on the rod the quick release device which controls a bead for securing a socket mounted on the driving member of the driving mechanism. The efficient directions and the socket are both controlled by one-time operation of the quick release device.

7 Claims, 5 Drawing Sheets

FIG. 5
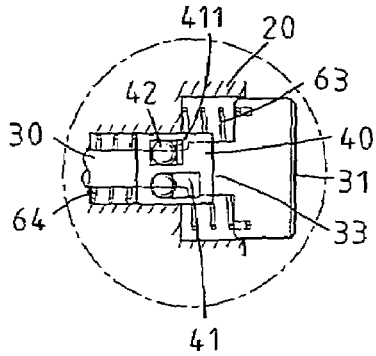
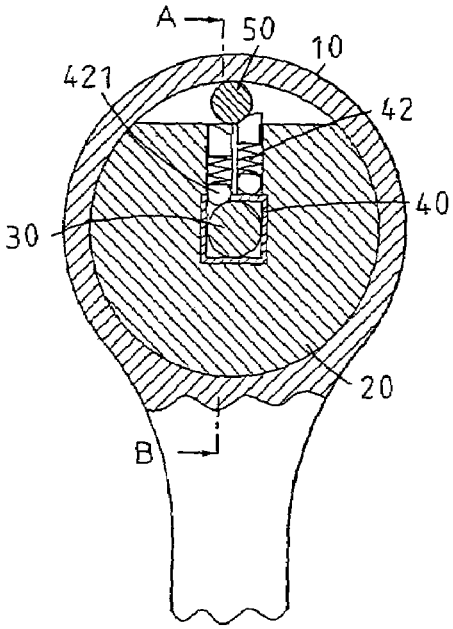
FIG. 3
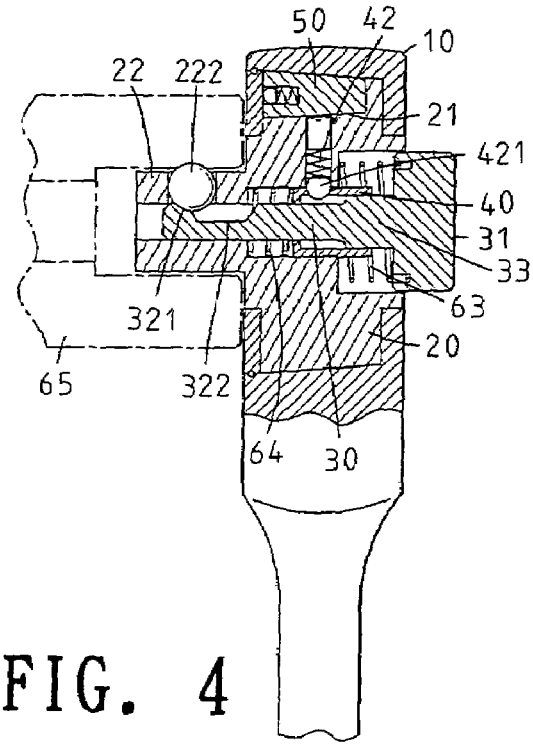
FIG. 4

QUICK RELEASE DEVICE FOR RATCHET TOOLS

FIELD OF THE INVENTION

The present invention relates to a quick release device for a ratchet tool and the quick release device controls the effective direction of the ratchet mechanism.

BACKGROUND OF THE INVENTION

A conventional ratchet tool for cooperation with socket generally includes a quick release device which allows the user to remove the socket from the driving head of the ratchet tool quickly. The conventional quick release device is a rod with an enlarged head and a bead is engaged with a recess defined in an outer periphery of the rod. When pushing the enlarged head to merge the rod into the driving head, the bead is moved inward from the driving head and received in the recess in the rod so that the socket can be dismounted from the driving head because the bead does not urge the inner periphery of the socket. Besides, the ratchet tool can be used to rotate in two directions to output torque as needed, the device for controlling the effective direction generally is a control lever which is located on a top surface of the ratchet tool so that the user can operate the control lever to set the desired direction of the ratchet tool. That is to say, the user has to operate two different members which are the enlarged head of the quick release device and the control lever, if he or she wants to change the effective direction and to remove the socket. The quick release device and the control lever are two separated devices and have different shapes of parts, so that the manufacturers have to manufacture them in separate and install them to the ratchet tool separately.

The present invention intends to provide a quick release device for a ratchet tool, wherein the quick release device is able to change the effective direction and to release the socket in one action.

SUMMARY OF THE INVENTION

The present invention relates to a ratchet tool which comprises a head connected with a handle and a driving mechanism is received in a cylindrical space defined in the head. The driving mechanism has a cylindrical body and a polygonal driving member extends from the cylindrical body. The driving member has a longitudinal hole defined therethrough and a side hole is defined in a side of the driving member, wherein the side hole communicates with the longitudinal hole. A flat surface is defined in an outer periphery of the cylindrical body and two radial passages are defined radially in the cylindrical body and open to the flat surface. A quick release device includes an enlarged head and a rod which is connected to the enlarged head and movably inserted into the central passage and the longitudinal hole of the driving mechanism. A first spring is mounted on the rod and biased between the enlarged head and stepped surface in the central passage. A recess is defined in an outer periphery of the rod and a first bead is movably received in the side hole of the driving member and the recess. A part of the first bead protrudes out from the side hole when the bead is not received in the recess. A hollow shifting member is movably mounted on the rod and has two windows defined through a side thereof. The two windows are located at different heights along a longitudinal axis of the rod. Two positioning units are received in the two radial passages and include two respective end members which retractably protrude from two apertures of the two radial passages in the flat surface.

A bar is located in an operation space defined between the flat surface of the cylindrical body and an inner periphery of the cylindrical space. The operation space has two wedge-shaped areas defined between two ends of the flat surface and the curved inner periphery of the cylindrical space. The bar is sized to be clamped in the two wedge-shaped areas and can be freely movable in a mediate area of the operation space. The bar is movably located between the two end members of the two positioning units. A second spring is mounted on the rod of the quick release device and biased between the shifting member and another stepped surface in the central passage in the driving mechanism.

The primary object of the present invention is to provide a release device for a ratchet tool wherein the change of effective direction of the ratchet tool and replacement of the socket can be completed by pushing the quick release device.

The present invention will become more obvious from the following description when taken in connection with the accompanying drawings which show, for purposes of illustration only, a preferred embodiment in accordance with the present invention.

BRIEF DESCRIPTION OF THE DRAWINGS

FIG. 3 is an end cross section al view to show that the bar is pushed by one of the two end members of the positioning units of the present invention;

FIG. 4 is a side cross sectional view along line A–B in FIG. 3;

FIG. 5 shows that the position relationship of the two second beads and the two windows in the shifting member;

DETAILED DESCRIPTION OF THE PREFERRED EMBODIMENT

Figure 1:
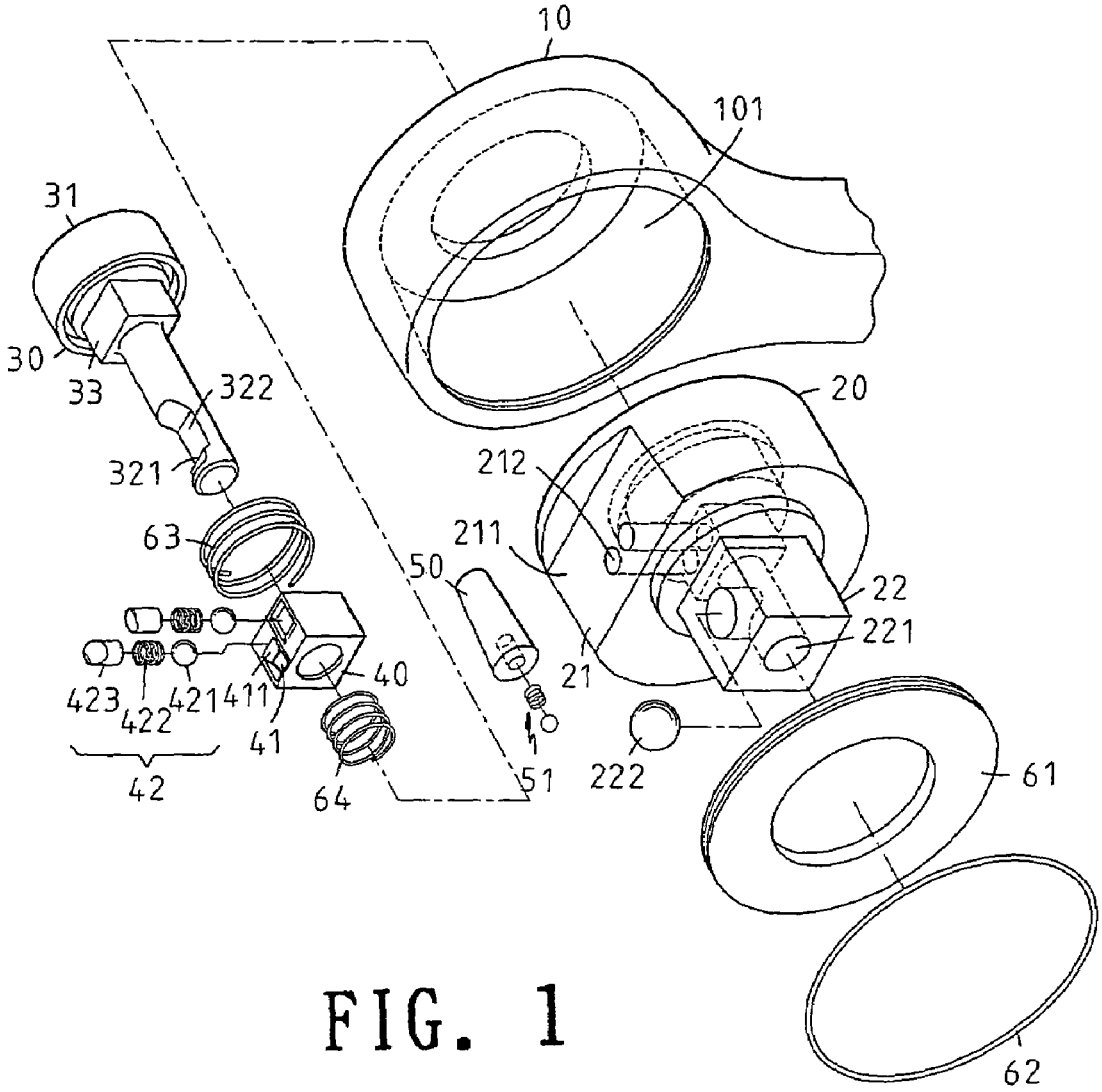
FIG. 1 is an exploded view to show the ratchet tool of the present invention.
Figure 2:
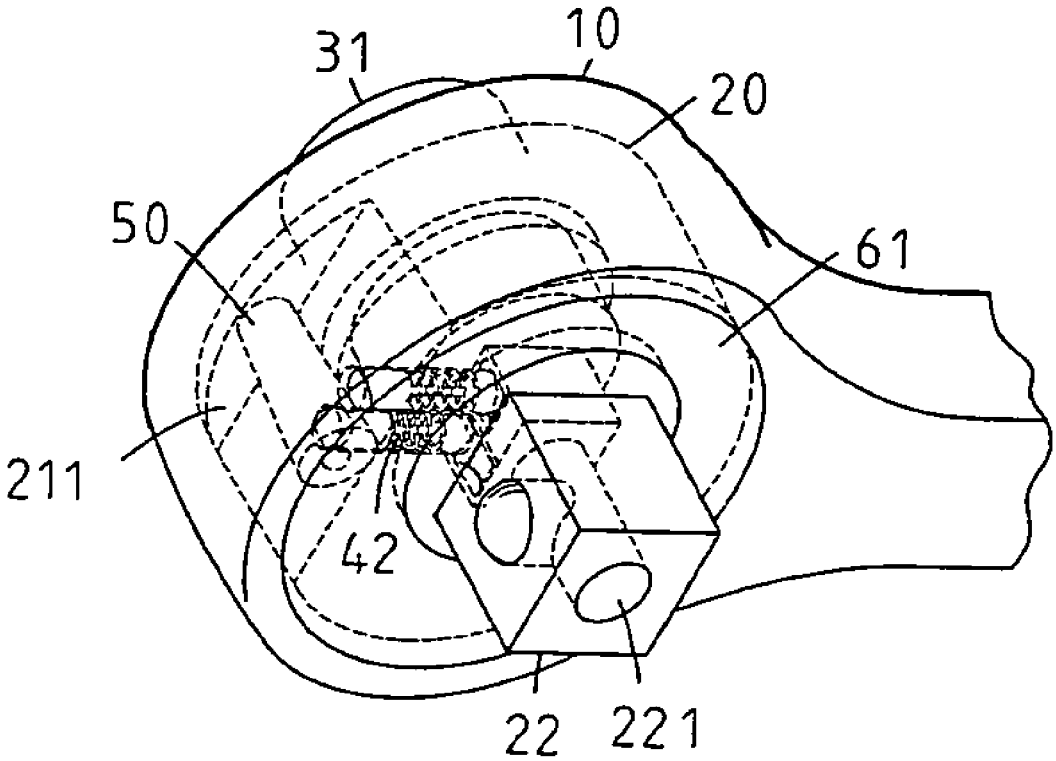
FIG. 2 is a perspective view to show the ratchet tool of the present invention.

Referring to FIGS. 1 to 5, the ratchet tool of the present invention comprises a head 10 connected with a handle and a cylindrical space 101 is defined in the head 10. A driving mechanism has a cylindrical body 20 and a polygonal driving member 22 extends from the cylindrical body 20 which is rotatably received in the cylindrical space 101. A ratchet mechanism (not shown) is cooperated with the driving member 22 and a longitudinal hole 221 is defined through the driving member 22. A side hole is defined in a side of the driving member 22 and communicates with the longitudinal hole 221. A central passage is defined in the cylindrical body 20 and located opposite to the driving member 22. The central passage communicates with the longitudinal hole 221. A flat surface 21 is defined in an outer periphery of the cylindrical body 20 and two radial passages 212 is defined radially in the cylindrical body 20 and open to the flat surface 21 so as to form two apertures in the flat surface 21. The two radial passages 212 communicate with the central passage in the cylindrical body.

A quick release device 30 including an enlarged head 31 and a rod which is connected to the enlarged head 31 and movably inserted into the central passage and the longitudinal hole 221 of the driving mechanism 20. A first spring 63 is mounted on the rod and biased between the enlarged head 31 and stepped surface in the central passage. By the first spring 63, the enlarged head 31 protrudes from a side of the head 10. A recess 322 is defined in an outer periphery of the rod and a first bead 222 is movably received in the side hole of the driving member 22 and the recess 322. A part of the first bead 222 protrudes out from the side hole when the bead 222 is not received in the recess 322. The recess 322 in the rod includes two inclined surfaces 321 and the first bead 321 is pushed by one of the two inclined surfaces 321 to protrude from the side hole of the driving member 22.

A hollow and rectangular shifting member 40 is movably mounted on a rectangular section 33 on the rod of the quick release device 30. Two windows 41 are defined through a side of a wall of the hollow shifting member 40 and the two windows 41 are located at different heights along a longitudinal axis of the rod. Each of the windows 41 includes an inclined side 411. A second spring 64 is mounted on the rod of the quick release device 30 and biased between the shifting member 40 and another stepped surface in the central passage in the driving mechanism 20.

Two positioning units 42 are received in the two radial passages 212 and each positioning unit 42 includes a second bead 421, a biasing member 422 and an end member 423, wherein the biasing member 422 is located between the second bead 421 and the end member 423. The second beads 421 are alternatively engaged with the two windows 41 and can be pushed away from the windows 41 when the shifting member 40 is moved. By the second spring 64, the shifting member 40 is maintained at a position where one of the end members 423 protrudes out from the aperture in the flat surface 21. In other words, the two respective end members 423 retractably and alternatively protrude from two apertures of the two radial passages 212 in the flat surface 21 by the movement of the shifting member 40. The positioning unit 42 whose second bead 421 is engaged with the window 41, the end member 423 is merged in the radial passage 212. The other positioning unit 42 whose second bead 421 is not engaged with the window 41 corresponding thereto, the end member 423 protrudes out from the aperture in the flat surface 21.

A bar 50 is located in an operation space 211 defined between the flat surface 21 of the cylindrical body 20 and an inner periphery of the cylindrical space 101. A positioning device 51 including a spring and a bead is connected between an end of the bar 50 and an end plate 61 which closes the cylindrical space 101 of the head 10 and cooperated with a seal ring 62. The operation space 211 has two wedge-shaped areas defined between two ends of the flat surface 21 and the curved inner periphery of the cylindrical space 101. The bar 50 is sized to be clamped in either the two wedge-shaped areas and is freely movable in a mediate area of the operation space 211. The bar 50 is movably located between the two end members 423 of the two positioning units 42.

As disclosed in FIGS. 3 to 5, when the bar 50 is pushed by the end member 423 on the right, the bar is clamped in the wedge-shaped area at left of the operation space 211 so that when the driving mechanism is rotated clockwise, the bar 50 is stocked in the wedge-shaped area and the head 10 together with the driving mechanism are rotated clockwise to output a torque.

Figure 7:
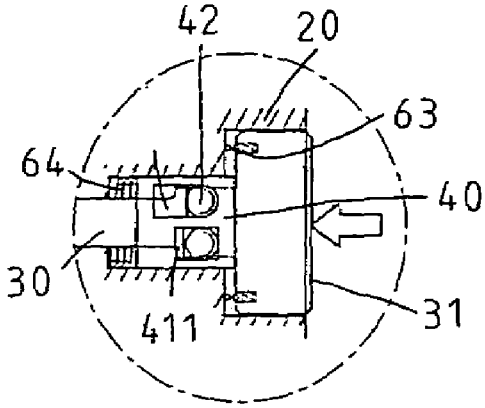
FIG. 7 shows that the two second beads are shifted by the two windows moved with the shifting member
Figure 6:
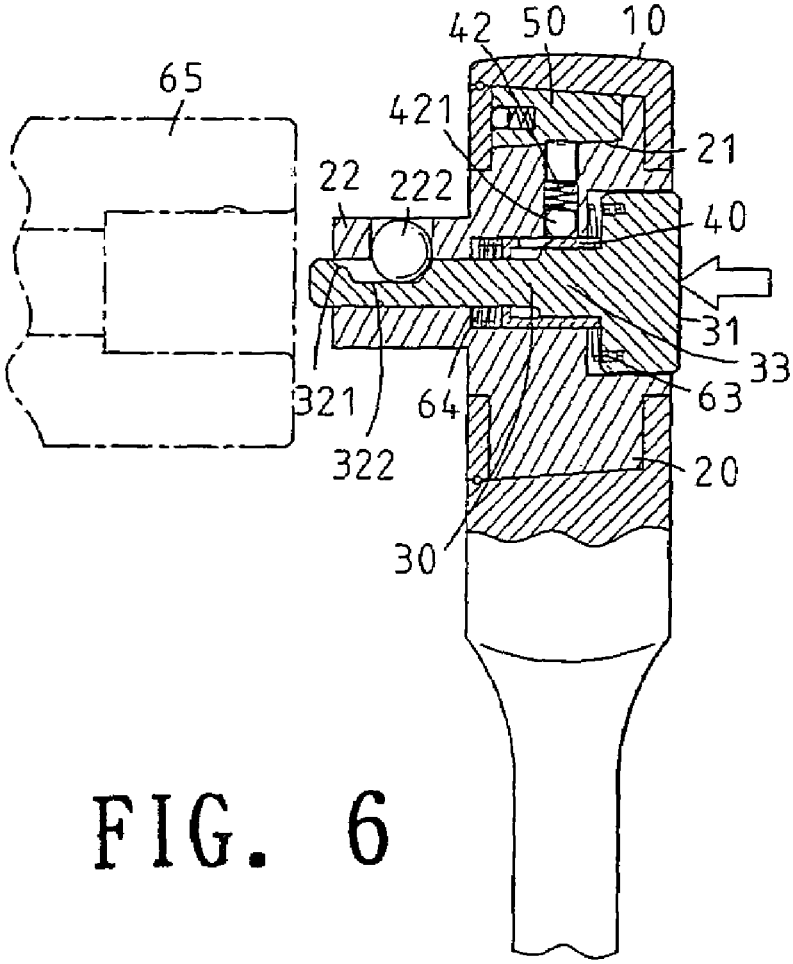
FIG. 6 is a cross sectional view to show that when the quick release device is pushed, the socket can be removed from the driving member.
Figure 10:
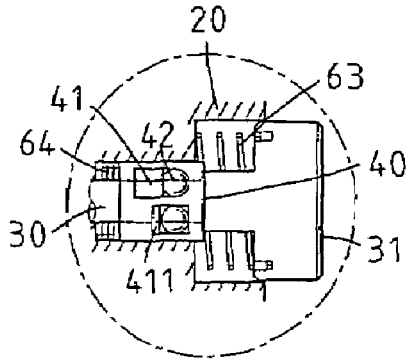
FIG. 10 shows that the position relationship of the two second beads and the two windows in the shifting member in FIG. 8.
Figure 8:
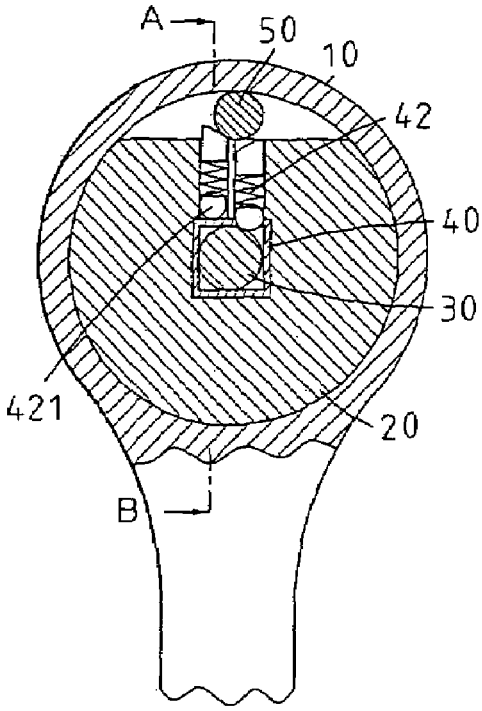
FIG. 8 is an end cross section al view to show that the bar is pushed by the other one of the two end members of the positioning units of the present invention.
Figure 9:
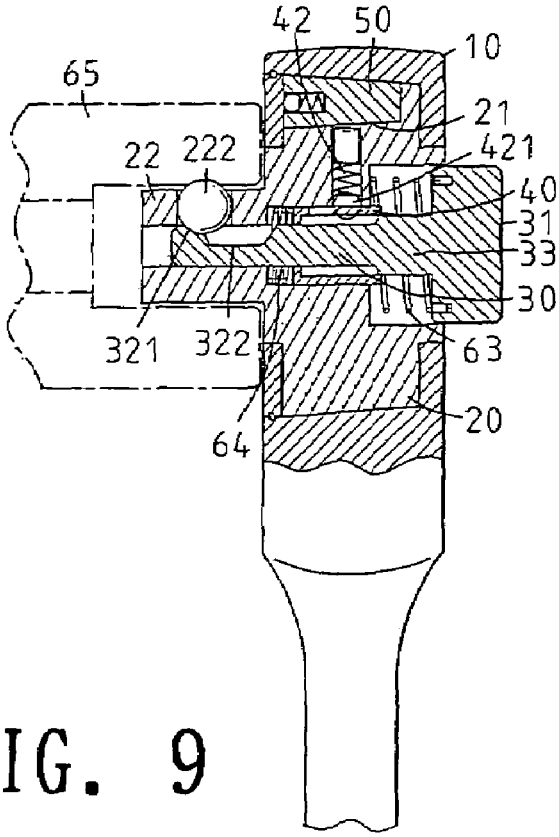
FIG. 9 is a side cross sectional view along line A–B in FIG. 8.

As shown in FIGS. 6 and 7, when pushing the enlarged head 31, the rod is moved and the first bead 222 drops into the recess 322 so that the socket 65 mounted on the driving member 22 can be easily removed. In the same time, the rectangular section 33 on the rod pushes the second bead 421 out from the window 41 and the shifting member 40 is moved with the movement of the rod, as shown in FIGS. 8 to 10. The inclined side 411 guides the second bead 421 to move away from the window 41. The positions of the two windows 41 are moved and because the two windows 41 are located at different heights along the axis of the rod, the left second bead 421 is not received in the window 41 corresponding thereto and the right second bead 421 is received in the window 41 corresponding thereto, the left end member 423 protrudes out from the aperture and pushes the bar 50 toward the right wedge-shaped area. In this position, the head 10 together with the driving mechanism can be rotated counter clockwise to output a torque. Accordingly, the socket 65 can be removed from the driving member 22 and the effective direction of the ratchet tool is changed by pushing the enlarged head 31 once.

It is noted that, in order to have a reliable engagement, the flat surface 21 and the inner periphery of the cylindrical space 101 of the operation space 211 are tapered and the bar 50 has a tapered outer periphery so as to match with the tapered the flat surface 21 and the inner periphery of the cylindrical space 101 of the operation space 211.

While we have shown and described the embodiment in accordance with the present invention, it should be clear to those skilled in the art that further embodiments may be made without departing from the scope of the present invention.

What is claimed is:

1. A ratchet tool comprising:

a head connected with a handle and a cylindrical space defined in the head;

a driving mechanism having a cylindrical body and a polygonal driving member extending from the cylindrical body which is rotatably received in the cylindrical space, the driving member having a longitudinal hole defined therethrough and a side hole defined in a side of the driving member, the side hole communicating with the longitudinal hole, a flat surface defined in an outer periphery of the cylindrical body and two radial passages defined radially in the cylindrical body and opening to the flat surface, the two radial passages communicating with a central passage defined in the cylindrical body, the central passage communicating with the longitudinal hole;

a quick release device including an enlarged head and a rod which is connected to the enlarged head and movably inserted into the central passage and the longitudinal hole of the driving mechanism, a first spring mounted on the rod and biased between the enlarged head and stepped surface in the central passage, a recess defined in an outer periphery of the rod and a first bead movably received in the side hole of the driving member and the recess, a part of the first bead protruding out from the side hole when the bead is not received in the recess;

a hollow shifting member movably mounted on the rod and having two windows defined through a side of a wall of the hollow shifting member, the two windows located at different heights along a longitudinal axis of the rod, two positioning units received in the two radial passages and including two respective end members which retractably and alternatively protrude from two apertures of the two radial passages in the flat surface, and a bar located in an operation space defined between the flat surface of the cylindrical body and a curved inner periphery of the cylindrical space, the operation space having two wedge-shaped areas defined between two ends of the flat surface and the curved inner periphery of the cylindrical space, the bar being sized to be clamped in the two wedge-shaped areas and being freely movable in a mediate area of the operation space, the bar movably located between the two end members of the two positioning units, a second spring mounted on the rod of the quick release device and biased between the shifting member and another stepped surface in the central passage in the driving mechanism.

2. The ratchet tool as claimed in claim 1, wherein the rod of the quick release device includes a rectangular section and the shifting member is a rectangular member which is movably mounted on the rectangular section.

3. The ratchet tool as claimed in claim 1, wherein each of the positioning units includes a second bead, a biasing member and the end member, wherein the biasing member is located between the second bead and the end member, the second beads are alternatively engaged with the two windows.

4. The ratchet tool as claimed in claim 3, wherein each of the windows includes an inclined side which guides the second bead to move away from the window.

5. The ratchet tool as claimed in claim 1, wherein a positioning device is connected between an end of the bar and an end plate which closes the cylindrical space of the head.

6. The ratchet tool as claimed in claim 1, wherein the flat surface and the inner periphery of the cylindrical space of the operation space are tapered and the bar has a tapered outer periphery so as to match with the tapered the flat surface and the inner periphery of the cylindrical space of the operation space.

7. The ratchet tool as claimed in claim 1, wherein the recess in the rod includes two inclined surfaces and the first bead is pushed by one of the two inclined surfaces to protrude from the side hole of the driving member.

* * * * *